US007008676B2

(12) United States Patent
Romano, Jr. et al.

(10) Patent No.: US 7,008,676 B2
(45) **Date of Patent: *Mar. 7, 2006**

(54) INK JET RECORDING ELEMENT

(75) Inventors: Charles E. Romano, Jr., Rochester, NY (US); Richard J. Kapusniak, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 207 days.

This patent is subject to a terminal disclaimer.

(21) Appl. No.: 10/214,266

(22) Filed: Aug. 7, 2002

(65) Prior Publication Data

US 2004/0028843 A1 Feb. 12, 2004

(51) Int. Cl.
*B41M 5/00* (2006.01)

(52) U.S. Cl. ..... 428/32.24; 428/32.14; 428/32.29; 428/32.3

(58) Field of Classification Search ..... 428/32.24, 428/32.27, 32.29, 32.3, 32.28, 32.38; 347/105
See application file for complete search history.

(56) References Cited

U.S. PATENT DOCUMENTS

| | | | | |
|---|---|---|---|---|
| 6,364,477 | B1 * | 4/2002 | Missell et al. | 347/105 |
| 2003/0157276 | A1 * | 8/2003 | Romano | 428/32.1 |

FOREIGN PATENT DOCUMENTS

| | | | |
|---|---|---|---|
| DE | 197 21 238 | A1 | 11/1998 |
| EP | 1080937 | A | 3/2001 |
| EP | 1106378 | A | 6/2001 |
| EP | 1184194 | A | 3/2002 |
| EP | 1211089 | A | 6/2002 |

* cited by examiner

*Primary Examiner*—Pamela R. Schwartz
(74) *Attorney, Agent, or Firm*—Harold E. Cole; Chris P. Konkol

(57) ABSTRACT

An ink jet recording element having a substrate having thereon: a) a subbing layer comprising an amine inactivated gelatin; and b) an image-receiving layer of a cross-linkable polymer containing hydroxyl groups and a polymeric mordant, the cross-linkable polymer being present at a thickness of from about 2 to about 40 $\mu$m and the weight ratio of the cross-linkable polymer to the mordant being from about 30:70 to about 95:5.

6 Claims, No Drawings

INK JET RECORDING ELEMENT

CROSS REFERENCE TO RELATED APPLICATIONS

Reference is made to commonly assigned, co-pending U.S. patent applications:

Ser. No. 10/214,265 by Charles E. Romano. Jr. et al. filed Aug. 7, 2002, entitled "Ink Jet Printing Method; and Ser. No. 10/068,446 by Charles E. Romano, Jr. et al., filed Feb. 6, 2002, entitled "Ink Recording Element Having Adhesion Promoting Material now U.S. Pat. No. 6,827, 992."

FIELD OF THE INVENTION

This invention relates to an ink jet recording element. More particularly, this invention relates to a subbing layer for an ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image-recording elements for use with ink jet printing are known, there are many unsolved problems in the art and many deficiencies in the known products which have severely limited their commercial usefulness. A major challenge in the design of a porous image-recording layer is to be able to obtain good quality, crack-free coatings with as little non-particulate matter as possible. If too much non-particulate matter is present, the image-recording layer will not be porous and will exhibit poor ink dry times.

DE 197 21 238 A1 discloses the use of a single layer of gelatin modified with dodecenylsuccinic acid in ink jet papers. However, it does not disclose the use of succinylated gelatin as a subbing layer.

It is an object of this invention to provide a subbing layer for an ink jet recording element that has good adhesion between the support and the image-receiving layer.

SUMMARY OF THE INVENTION

This and other objects are achieved in accordance with the invention which comprises an ink jet recording element comprising a substrate having thereon:

a) a subbing layer comprising an amine inactivated gelatin; and b) an image-receiving layer comprising a cross-linkable polymer containing hydroxyl groups and a polymeric mordant, the cross-linkable polymer being present at a thickness of from about 2 to about 40 $\mu$m and the weight ratio of the cross-linkable polymer to the mordant being from about 30:70 to about 95:5.

The ink jet recording element of the invention has a subbing layer that provides good adhesion between the support and the image-receiving layer.

DETAILED DESCRIPTION OF THE INVENTION

The amine inactivated gelatin used in the invention may comprise gelatin where the amino group is inactivated, such as acetylated gelatin, phthalated gelatin, malenoylated gelatin, benzoylated gelatin, succinylated gelatin, methyl urea gelatin, phenylcarbamoylated gelatin, or carboxy modified gelatin. In a preferred embodiment, the gelatin has a bloom strength of between 100 grams and 350 grams.

The subbing layer provides good adhesion of the image-receiving layer to the support. In a preferred embodiment of the invention, the subbing layer comprises gelatin having succinyl groups, such as succinylated pigskin gelatin. In another preferred embodiment, the subbing layer comprises gelatin having phthalyl groups, such as phthalated bone gelatin. In another preferred embodiment, the subbing layer also contains poly(vinyl alcohol). The subbing layer employed in the ink image-recording layer may be present in any amount that is effective for the intended purpose. In general, the preferred dry layer thickness is from about 0.5 $\mu$m to 5 $\mu$m.

The cross-linkable polymer containing hydroxyl groups employed in the image-receiving layer may be, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers such as hydroxyethylcellulose, etc. In a preferred embodiment, the cross-linkable polymer containing hydroxyl groups is poly(vinyl alcohol) or partially hydrolyzed poly(vinyl acetate/vinyl alcohol).

The image-receiving layer also contains a polymeric mordant such as a cationic polymer, e.g., a polymeric quaternary ammonium compound, or a basic polymer, such as poly(N,N-dimethylaminoethyl methacrylate), polyalkylenepolyamines, and products of the condensation thereof with dicyanodiamide, amine-epichlorohydrin polycondensates, lecithin and phospholipid compounds. Examples of mordants useful in the invention include poly(vinylbenzyldimethylcyclohexylammonium chloride-co-styrene-co-divinylbenzene), poly(vinylbenzyltrimethylammonium chloride-co-ethylene glycol dimethacrylate), poly(vinylbenzyltrimethylammonium chloride-co-divinylbenzene), poly (diallyldimethylammonium chloride), poly([2-(methacryloyloxy)ethyl]trimethylammonium methylsulfate), poly([3-(methacryloyloxy)propyl]trimethylammonium chloride), a copolymer of vinylpyrrolidinone and 1-vinyl-3-methylimidazolium chloride, and hydroxyethyl cellulose derivitized with 1-chloro-3-(N,N,N-trimethylammonium)propane. In a preferred embodiment, the polymeric mordant is poly(vinylbenzyltrimethylammonium chloride-co-divinylbenzene).

The image-receiving layer may also contain other hydrophilic materials such as naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), non-modified gelatins, polyvinylmethyloxazoline, polyoxides, polyethers, poly(ethylene imine), poly(acrylic acid), poly(methacrylic acid), n-vinyl amides including polyacrylamide and polyvinylpyrrolidinone (PVP), and poly(vinyl alcohol) derivatives and copolymers, such as copolymers of poly(ethylene oxide) and poly(vinyl alcohol) (PEO-PVA).

The image-receiving layer employed in the invention may be present in any amount that is effective for the intended purpose. In general, the preferred dry layer thickness is from about 5 $\mu$m to 60 $\mu$m.

The image-receiving layer may optionally be overcoated with one or more hydrophilic layers comprising cellulose ether or cationically modified cellulose ether, such as methyl cellulose-(MC), ethyl cellulose, hydroxypropyl cellulose (HPC), sodium carboxymethyl cellulose (CMC), calcium carboxymethyl cellulose, methylethyl cellulose, methylhydroxyethyl cellulose, hydroxypropylmethyl cellulose (HPMC), hydroxybutylmethyl cellulose, ethylhydroxyethyl cellulose, sodium carboxymethyl-hydroxyethyl cellulose, and carboxymethylethyl cellulose, and cellulose ether esters such as hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide (HEC-LDME), such as Quatrisoft® LM200 (Amerchol Corp.), as well as hydroxyethyl cellulose grafted with alkyl $C_{12}$–$C_{14}$ chains.

Matte particles may be added to any or all of the layers described in order to provide enhanced printer transport, resistance to ink offset, or to change the appearance of the ink receiving layer to satin or matte finish. In addition, surfactants, defoamers, or other coatability-enhancing materials may be added as required by the coating technique chosen.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly (butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

While not necessary, the various layers described above may also include a crosslinker. Such an additive can improve the adhesion of the ink receptive layer to the substrate as well as contribute to the cohesive strength and water resistance of the layer. Crosslinkers such as carbodiimides, polyfunctional aziridines, melamine formaldehydes, isocyanates, epoxides, and the like may be used. If a crosslinker is added, care must be taken that excessive amounts are not used as this will decrease the swellability of the layer, reducing the drying rate of the printed areas.

In order to improve the adhesion of the image-receiving layer to the support, the surface of the support may be subjected to a corona-discharge treatment prior to applying the subbing layer.

The above coating composition can be coated either from water or organic solvents, however water is preferred. The total solids content should be selected to yield a useful coating thickness in the most economical way, and for particulate coating formulations, solids contents from 10–40 wt. % are typical.

The coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

After coating, the ink jet recording element may be subject to calendering or supercalendering to enhance surface smoothness.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following example is provided to illustrate the invention.

EXAMPLE

Control Element C-1 (Non-Inactivated Amine Bone Gelatin)

A polyethylene resin coated paper was treated by corona discharge and coated by means of a slide hopper with a 6 wt. % bone gelatin solution in water, (Eastman Gelatine Co.), dry coverage of about 1.5 $\mu$m and an image receiving layer of 6 wt. % solution of Gohsenol® GH-17 poly(vinyl alcohol) (Nippon Gohsei), a mordant of a 15 wt. % dispersion of poly(vinylbenzyltrimethylammonium chloride-co-divinylbenzene) (Eastman Kodak Company) and 10 wt % solution of Olin 10G surfactant, where the poly(vinyl alcohol) (PVA), mordant dispersion, and surfactant were mixed in a 89.5:9.5:1 ratio by weight at a dry coverage of 8 $\mu$m.

The coating was dried thoroughly by forced air heat after application of the coating solutions.

Control Element C-2 (Non-Inactivated Amine Pigskin Gelatin)

This element was prepared the same as C-1 except that a pigskin gelatin was used instead of bone gelatin.

Element 1 of the Invention (Succinylated Pigskin Gelatin)

This element was prepared the same as C-1 except that a succinylated pigskin gelatin (Kind & Knox Gelatine) was used instead of bone gelatin.

Element 2 of the Invention (Phthalated Bone Gelatin)

This element was prepared the same as C-1 except that a phthalated bone gelatin (Eastman Gelatine Co.) was used instead of bone gelatin.

Element 3 of the Invention (Succinylated Pigskin Gelatin and PVA)

This element was prepared the same as C-1 except that a 50:50 mixture by weight of succinylated pigskin gelatin and GH-17 poly(vinyl alcohol) was used instead of bone gelatin.

Element 4 of the Invention (Succinylated Pigskin Gelatin, PVA and Mordant)

This element was prepared the same as C-1 except that a 50:45:5 mixture by weight of succinylated pigskin gelatin, GH-17 poly(vinyl alcohol) and the mordant in C-1 was used instead of bone gelatin.

Element 5 of the Invention (Succinylated Pigskin Gelatin, PVA and Mordant)

This element was prepared the same as C-1 except that a 10:81:9 mixture by weight of succinylated pigskin gelatin, GH-17 poly(vinyl alcohol) and the mordant in C-1 was used instead of bone gelatin.

Printing

Each element was imaged using a HP PhotoSmart 1115 ink jet printer and ink jet inks, Cartridge No. 51645a (black) and c6578d (color) with a test target consisting of patches of 100% laydown of cyan, magenta, yellow, 200% laydown of red, green, blue, and dried in a warm air oven at 80° C. for 30 minutes.

Testing

The above elements were cut with a paper cutter across each patch. A piece of 3M Scotch brand Magic Tape 810 adhesive tape was placed on the cut edge of each patch. The tape was then quickly removed and examined for the presence of coating. The presence of coating was considered to be adhesion failure. The results are shown in Table 1 below.

TABLE 1

| Element | Adhesion Failure |
|---|---|
| C-1 | Yes |
| C-2 | Yes |
| 1 | No |
| 2 | No |
| 3 | No |
| 4 | No |
| 5 | No |

The above results show that the subbing layer used in accordance with the invention provided elements that had better adhesion than the control elements.

This invention has been described with particular reference to preferred embodiments thereof but it will be understood that modifications can be made within the spirit and scope of the invention.

What is claimed is:

1. An ink jet recording element comprising a support having thereon:

(a) a subbing layer, having a thickness of 0.5 to 1.5 μm, comprising gelatin and poly(vinyl alcohol), wherein the gelatin comprises an amine inactivated gelatin having succinyl groups, and (b) an image-receiving layer comprising poly(vinyl alcohol) and a polymeric mordant, said image-receiving layer having a thickness of from about 5 to about 60 μm, wherein the weight ratio of said poly(vinvl alcohol) to said polymeric mordant is from about 30:70 to about 95:5, and wherein said subbing layer (a) provides adhesion of said image-receiving layer to said support.

2. The recording element of claim 1 wherein said amine inactivated gelatin comprises succinylated pigskin gelatin.

3. The ink recording element of claim 2 wherein said succinylated pigskin gelatin is present in said mixture in an amount between about 5% and about 95% by weight.

4. The ink recording element of claim 1 wherein said subbing layer also contains a polymeric mordant.

5. The ink recording element of claim 4 wherein said polymeric mordant in said subbing layer is present in an amount of from about 5 to about 10% by weight.

6. The ink recording element of claim 1 wherein said polymeric mordant in said image-receiving layer comprises poly(vinylbenzyltrimethylammonium chloride-co-divinylbenzene).

* * * * *